United States Patent [19]

Fusaro et al.

[11] Patent Number: 5,067,866

[45] Date of Patent: Nov. 26, 1991

[54] DEVICE FOR GARAGING MOTOR VEHICLES

[75] Inventors: Angelo Fusaro; Giancarlo Galeazzi, both of Volta Mantovana, Italy

[73] Assignee: A.F.G. S.r.l., Volta Mantovana, Italy

[21] Appl. No.: 537,732

[22] Filed: Jun. 14, 1990

[51] Int. Cl.[5] ..... E01F 9/00

[52] U.S. Cl. ..... 414/228; 414/261; 414/234; 187/8.41; 52/169.6; 52/174

[58] Field of Search ..... 414/227, 228, 231, 232, 414/233, 234, 239, 242, 252, 253, 261; 187/8.41, 8.43, 8.45, 8.47, 8.49, 8.5, 8.52, 8.54, 8.59, 8.62, 8.69, 8.77, 17; 52/175, 169.6, 67

[56] References Cited

U.S. PATENT DOCUMENTS

| | | | |
|---|---|---|---|
| 1,771,695 | 7/1930 | Tompkins | 414/261 |
| 2,593,635 | 4/1952 | Walker | 187/8.41 X |
| 2,687,815 | 8/1954 | Simon | 414/228 X |
| 3,330,083 | 7/1967 | Jaulmes | 52/174 |
| 4,284,173 | 8/1981 | Patterson | 52/174 X |
| 4,747,242 | 5/1988 | Aarstad | 414/227 X |

FOREIGN PATENT DOCUMENTS

| | | | |
|---|---|---|---|
| 253427 | 4/1967 | Austria | 414/228 |
| 2644022 | 4/1978 | Fed. Rep. of Germany | 414/228 |
| 3246961 | 3/1984 | Fed. Rep. of Germany | 52/174 |
| 6405553 | 11/1965 | Netherlands | 52/169.6 |
| 2077708 | 12/1981 | United Kingdom | 52/174 |

*Primary Examiner*—Frank E. Werner

*Attorney, Agent, or Firm*—Guido Modiano; Albert Josif

[57] ABSTRACT

The device has two substantially vertical fixed guides along which sliders actuated by hydraulic cylinders can slide. The sliders support platforms which are each adapted to accommodate a motor vehicle. A bracket for each platform is associated with each slider and supports a profiled element on which the edge of the platform rests. The profiled element is provided with a gutter for conveying liquids to its ends.

22 Claims, 3 Drawing Sheets

1
2
3
4
5
6
7
8
9
10
11
12
13
16
17
19
3a
7a

DEVICE FOR GARAGING MOTOR VEHICLES

BACKGROUND OF THE INVENTION

The invention relates to a device for garaging motor vehicles.

As known, widespread use is made of motor-vehicle garaging devices, which accommodate vehicles in limited spaces and which are made in various ways.

The same Applicants has provided a device which is adapted to be accommodated in a pit and comprises two substantially vertical fixed guides on which sliders, one for each guide, slide and are actuated by movement means normally constituted by hydraulic cylinders; and sliders support at least two platforms, each adapted to accommodate at least one motor vehicle, and the vehicles are moved with respect to the device simply by bringing the platforms of the device, one at a time, to the level of the pavement adjacent to the uppermost edges of the pit in which the device is installed, so as to allow the transfer of the vehicles.

The same Applicants has also provided a device such as the one described above which is provided with a covering which lies above the vehicle accommodation platforms and is adapted to move, in the condition of maximum lowering of the device, to the level of the pavement which surrounds the pit, so as to cause the complete concealment of the device itself together with all the vehicles loaded thereon.

The above-described devices have obtained excellent results, but continuous study and the experience gained have allowed to provide further particularly advantageous characteristics.

SUMMARY OF THE INVENTION

The aim of the present invention is to provide a device for garaging motor vehicles which has excellent characteristics of protection against the effects of weather and also protects the garaged vehicles against any liquid which may drip from the device and/or other garaged vehicles, such as rain water, oil etc.

Within the scope of the above described aim, an object of the invention is to provide a device which is very simple, so as to ensure a limited cost.

A further object of the invention is to provide a device which is highly reliable in operation and easy to inspect.

The proposed aim and the above mentioned objects, as well as other objects which will become apparent hereinafter, are achieved by a device for garaging motor vehicles, according to the invention, which comprises two substantially vertical fixed guides on which sliders, one for each guide, slide and are actuated by movement means, said sliders supporting at least two platforms, each adapted to accommodate at least one motor vehicle, characterized in that at least one bracket for each platform is associated with each slider and supports at least one profiled element for resting the platform at its edge throughout its entire length, said profiled element being provided with at least one gutter for conveying liquids to its ends.

Advantageously, the device according to the invention is characterized in that each of said at least two platforms adapted to accommodate at least one motor vehicle comprises a plurality of sheet metal panels provided with U-shaped ribs adapted to stiffen the panel so as to make it self-supporting and allow the resting of said panel at its bottom on said profiled element supported by said bracket, said panels being furthermore provided with ridges having a triangular cross section which are parallel to said ribs and with flat regions arranged at their ends.

The device according to the invention furthermore advantageously comprises a covering which is supported by said sliders in a postion above said at least two platforms and is adapted to move, in the conditions of maximum lowering of the device, to the level of the pavement which surrounds a pit in which said device is installed, said device being characterized by the presence of a fixed gutter at the level of said pavement at the perimeter of the covering for collecting rain water, said gutter being shaped so as to define a minimum width at the upper outflow cross section and being provided with means adapted for resting said covering in the condition of maximum lowering.

BRIEF DESCRIPTION OF THE DRAWINGS

Further characteristics and advantages will become apparent from the description of some preferred but not exclusive embodiments of the invention, illustrated only by way of non-limitative example in the accompanying drawings, wherein.

DESCRIPTION OF THE PREFERRED EMBODIMENTS

Figure 1:
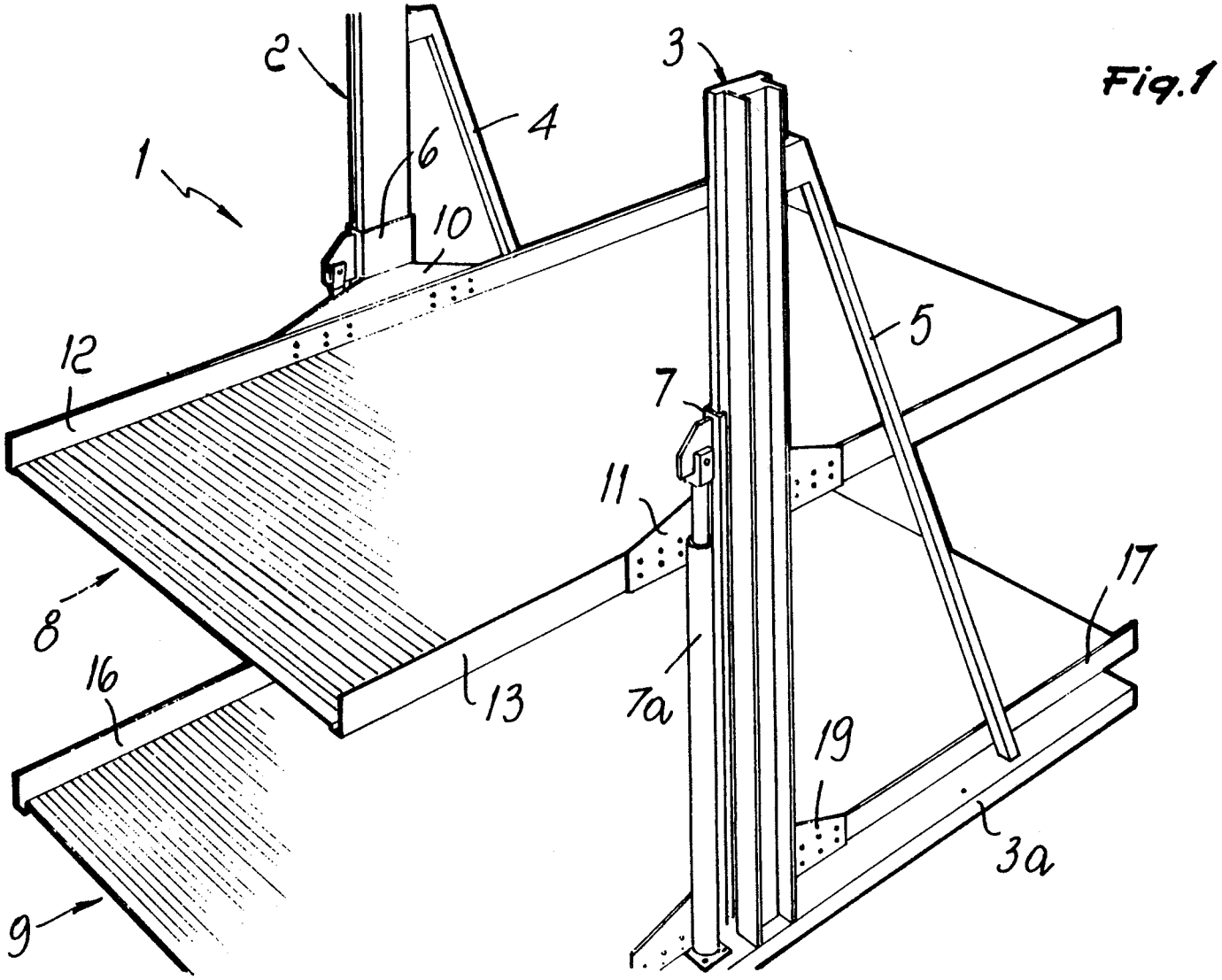
FIG. 1 is a perspective view of a device of the invention, according to a first embodiment thereof.
Figures 2, 3:
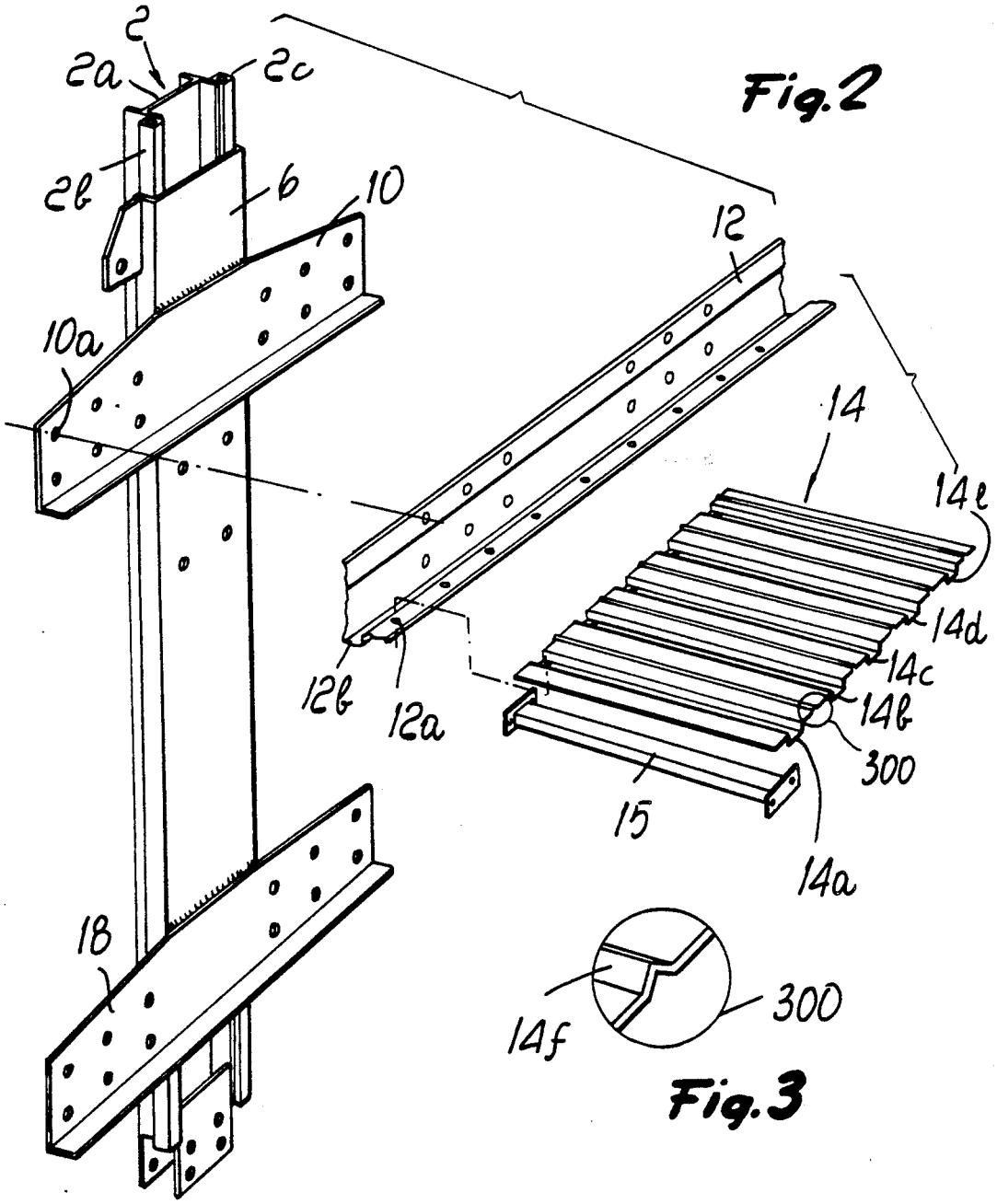
FIG. 2 is an exploded view of a detail of the device illustrated in FIG. 1.
FIG. 3 is an enlarged detail view illustrating one of the ridges of the panel shown within the circle 300 in FIG. 2.

With reference to the above FIGS. 1 and 2, the reference numeral 1 generally indicates a device which comprises two platforms adapted to accommodate at least one motor vehicle and is intended to be installed in a known manner inside a suitable pit which is not illustrated in the drawing figures.

Said device comprises two substantially vertical first and second fixed guides 2 and 3 which extend from resting plates **3*a* located at the bottom of the pit and are expediently provided with bracings 4 and 5. Obviously, one or more plates 3*a* may be provided below each guide, or alternatively, a single base element extending below both guides may be employed. A first slider 6 and a second slider 7 slide respectively on said guides and are simultaneously actuated by hydraulic cylinders, such as the cylinder 7*a* for activating the slider 7**.

All of this occurs in a known manner.

An important characteristic of the invention resides in the fact that platforms, generally indicated by the reference numerals 8 and 9, are rigidly associated with the sliders 6 and 7 in the manner described hereinafter with reference to the platform 8.

For this purpose, brackets 10 and 11 are rigidly associated or monolithically associated, e.g., by welding, with the sliders 6 and 7, and respectively support a fist profiled element 12 and a second profiled element 13 which are fixed thereto by fixing means, such as bolts, which pass through holes 10*a*. The platform 8 has edges, which rest on said profiled elements 12, 13 throughout its entire length, and is fixed to said profiled elements 12, 13 by fixing means, for example bolts, which pass through holes 12*a* formed in the profiled elements.

Very advantageously, the profiled elements 12 and 13 are shaped so as to include a drain channel or gutter. A gutter 12*b* formed on the profiled element 12 is illustrated in FIG. 2. It will be appreciated that an identical gutter is provided also at the opposite side of the platform 8 on the second profiled element 13. The gutters have the function of conveying to the ends of the platform any liquids which might be deposited on said platform, such as rain water or liquids from the engine or motor vehicles such as oil etc.

The correct removal of these liquids is important both regarding the preservation of the device and to avoid the possibility that such liquid could drip onto the vehicle or vehicles accommodated on the underlying platform.

The platform 8 is formed by a plurality of identical sheet metal panels, one of which is indicated by the reference numeral 14 in FIG. 2. Obviously, the platform 8 may be constituted by any number of panels, and such panels may be connected to each other and to the profiled element 12, 13 in any convenient manner such as, e.g., bolting.

Said panel 14 is provided with U-shaped ribs indicated by the reference numerals 14*a*, 14*b*, 14*c*, 14*d*, 14*e* which are adapted to stiffen the panel so as to make it self-supporting when it is rested on the profiled elements 12 and 13 at the bottom of said ribs where holes for the passage of fixing devices, such as bolts, are provided.

Said panel is also provided with a plurality of ridges 14*f* having a triangular cross section which act as grip points for the wheels of motor vehicles. Advantageously, each ridge 14*f* comprises, at its two ends, flat regions at which coupling to the contiguous panels is expediently effected by employing an underlying crosspiece 15, which is fixed, at its ends, e.g., by bolting or welding, to the profiled elements 12, 13.

The panel 14 is evidently extremely simple to manufacture and assemble and furthermore ensures a long working life since it is adapated to allow the easy control of any corrosion phenomena.

Al that has been described above with respect to the platform 8 applies in an identical manner also to the platform 9. In fact, the platform 9 is rigidly associated with the sliders 6 and 7 by resting on profiled elements 16 and 17 which are respectively supported by brackets 18 and 19 rigidly associated with said sliders 6, 7.

The coupling of the profiled elements 12 to the supporting brackets 10 by bolting makes the assembly of these elements, which may thus be disassembled during transport to reduce their bulk, particularly easy; in the same manner, the brackets 10 may also be assembled to the related sliders by means of bolting instead of by welding.

In FIG. 2 it can be seen that the guide 2 is made in the shape of a monolithic column by means of a steel profiled element in the shape of a double T, indicated by the reference numeral 2*a*. Quadrangular profiled elements 2*b* and 2*c*, on which the folded sides of the slider 6 slide, are associated, e.g., by welding, at the end of wings defined by the profiled element.

The guide 3 has an identical configuration to the guide 2.

Figure 4:
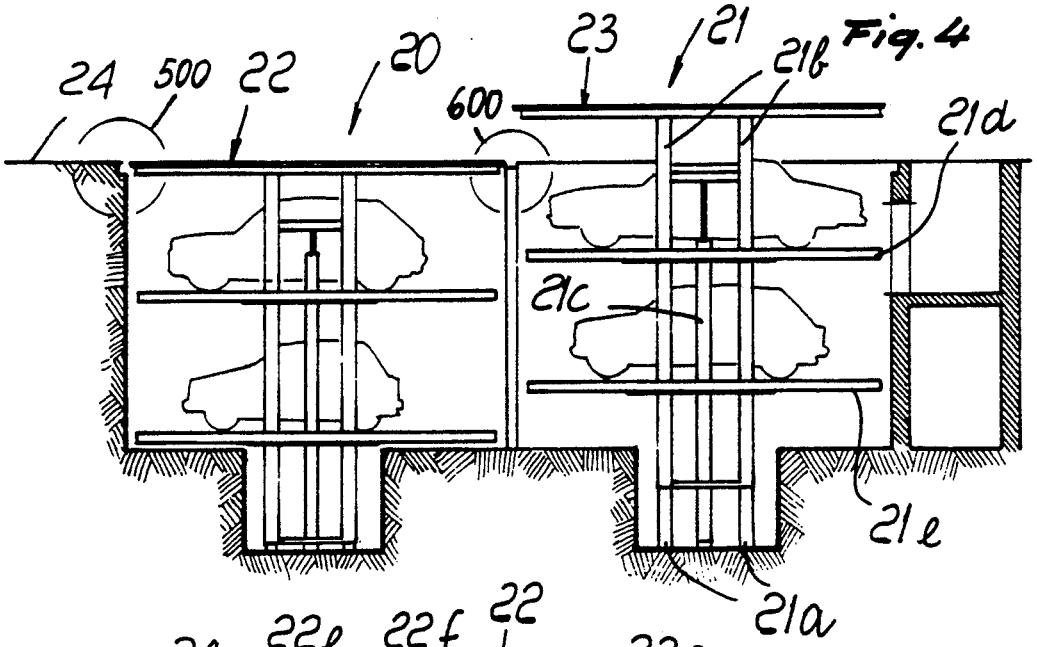
FIG. 4 is a schematic lateral elevation view of the assembly of two devices according to another aspect of the invention.

FIG. 4 illustrates an assembly of two devices, generally indicated by 20 and 21, located in a single pit within which the sliding guides 21*a* for the device 21 are provided. According to this embodiment, said guides are provided by means of two paired columns on which sliders 21*b* slide and are actuated by fluid-dynamic or hydraulic cylinders 21 which support, in the manner described above, platforms 21*d* , 21*e* for accommodating motor vehicles.

The sliders of the two devices support, at the upper end, coverings 22 and 23, which, in the position of maximum lowering of the device, i.e. in the lowermost position reached by the device 20, provide perfect continuity with the pavement 24 which surrounds the pit.

When it is necessary to move one of the garaged vehicles it is sufficient to raise the sliders until the platform which accommodates the vehicle to be moved is brought to the level of the pavement 24.

A fixed gutter is provided at the entire perimeter of the coverings at the level of the pavement 24 for collecting any rain water or other liquids which may have fallen onto said coverings. The gutter related to the device 20 is described in detail hereinbelow.

Figure 5:
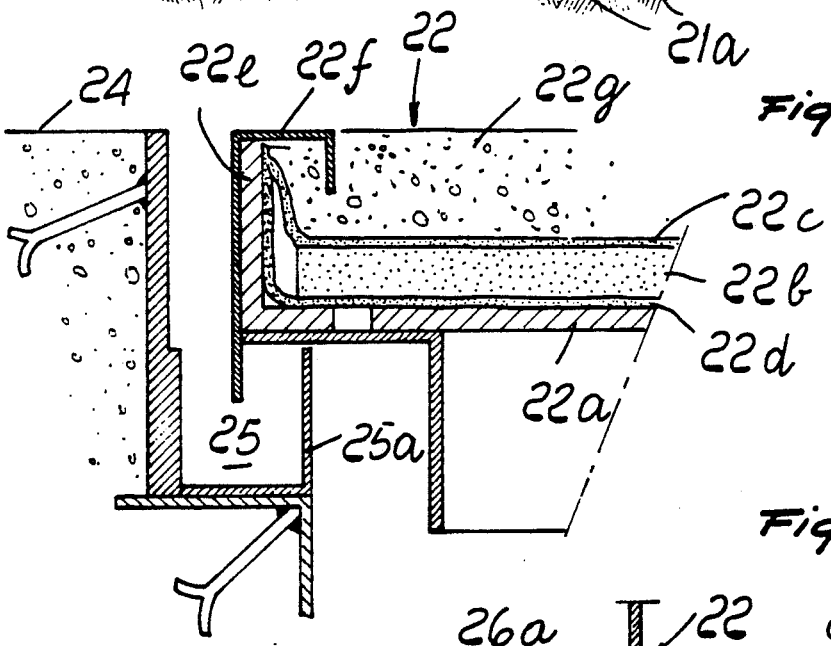
FIG. 5 is an enlarged detail view illustrating the arrangement of the gutter of the outer perimeter of the pit shown within the circle 500 in FIG. 4.
Figure 6:
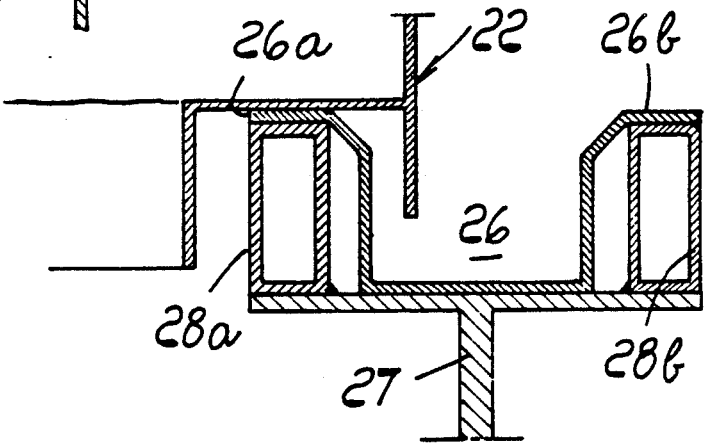
FIG. 6 is an enlarged detail view illustrating the gutter, provided between the adjacent upper perimeters of the two devices, shown within the circle 600 in FIG. 4.

At the sides of the devices which lie adjacent the perimeter of the pit, e.g., as indicated within the circle 500 in FIG. 4, the gutter is made as shown in FIG. 5. The gutter indicated by the reference numeral 25, is shaped so as to have a reduced width at the upper outlet section and is provided with means on which the covering 22 is adapted to be rested in the condition of maximum lowering of the device, said means being constituted by a ridge 25*a* for delimiting said gutter 25. FIG. 6 illustrates the arrangement of a gutter at the sides of the two devices being adjacent to each other in a position remote from the perimeter of the pit, as indicated within the circle 600 in FIG. 4.

At the sides of the devices directed toward the inside of the pit, the gutter 26, illustrated in FIG. 6, is supported by a beam 27 and has means for resting the coverings 22 and 23 constituted by stiffening stringers 28*a*, 28*b* in a position underlying the folded edges 26*a*, 26*b* of said gutter.

The covering 22 will now be described in detail; said covering comprises a base plate 22*a* on which an anticondensation panel 22 rests and is entirely covered by bituminous sheaths 22*c*, 22*d* which extend upward and adhere to a peripheral profiled element 22*e*, covered by a drip profile 22*f*. The covering is completed by the pavement surface 22*g*, which is advantageously identical to the pavement 24.

Excellent protection of the device against precipitation is afforded by means of all these provisions, ensuring its duration and efficiency for a long period of time.

Obviously, other conventional elevator means may be provided instead of the hydraulic cylinders, mentioned heretofore for operating the sliders.

The described invention is susceptible to numerous modifications and variations, all of which are within the scope of the inventive concept; all the details may furthermore be replaced with other technically equivalent elements.

In the practical execution of the invention, the materials employed, as well as the shapes and dimensions, may be any.

We claim:

1. Device for garaging motor vehicles comprising;
at least one base element;
at least two substantially vertical guides extending upwardly from said base element,
at least one first slider and at least one second slider, each slider being slideably associated with at least one of said guides,
actuation means for simultaneously sliding said first slider and said second sliders along said guides,
at least two vertically spaced-apart platforms rigidly connected to said first slider and said second slider, wherein each of said platforms comprises;
panel means for bearing wheels of motor vehicles, and
gutter means connected to said panel means for conveying liquids away from said motor vehicle wheels supported on said panel means,
whereby to prevent any liquids from dripping onto vehicles accommodated on an underlying platform, and whereby to prevent said panel means from retaining liquids which would remain in contact with said motor vehicle wheels supported on said panel means, wherein each of said platforms further comprises;
at least one bracket connected to said first slider,
at least another bracket connected to said second slider,
at least one first profiled element connected to said one bracket, and
at least one second profiled element connected to said other bracket,
wherein said gutter means comprise;
at least one gutter formed on said first profiled element and
at least one gutter formed on said second profiled element, and
wherein said panel means of each of said platforms comprise a plurality of panels, each panel among said plurality of panels being connected to said one profiled element and to said other profiled element.

2. Device for garaging motor vehicles according to claim 1, wherein said panel means of each of said platforms comprise a plurality of panels, and wherein each panel among said plurality of panels has formed thereon;
a plurality of U-shaped stiffening ribs, and
a plurality of grip-ridges,
a triangular cross section defined by each of said grip-ridges, and
a grip point for said motor vehicle wheel defined by said triangular cross section of each of said grip-ridges.

3. Device for garaging motor vehicles according to claim 1, wherein said panel means of each of said platforms comprise a plurality of panels, and wherein each panel among said plurality of panels has formed thereon;
a plurality of U-shaped stiffening ribs, and
a plurality of grip-ridges,
a triangular cross section defined by each of said grip-ridges,
a grip point for said motor vehicle wheel defined by said triangular cross section of each of said grip-ridges,
at least two ends defined by said grip-ridges, and
flat regions defined at said ends of said grip ridges, whereby to permit coupling to contiguous panels.

4. Device for garaging motor vehicles according to claim 3, further comprising at least one crosspiece, said crosspiece underlying said flat regions.

5. Device for garaging motor vehicles according to claim 1 further comprising, in combination, a covering member, said covering member comprising;
a base plate upwardly connected to said first slider and to said second slider and overlying said platforms,
an anti-condensation panel resting on said base plate, peripheral profiled element adjacent said base plate,
a drip profile covering said peripheral profiled element,
bituminous sheaths covering said base plate and said anti-condensation panel, said bituminous sheaths extending upwardly and adhering to said peripheral profiled element, and
a pavement surface applied to said bituminous sheaths.

6. Device for garaging motor vehicles according to claim 5, further comprising, in combination;
a pit perimeter gutter, said pit perimeter gutter being installable around the perimeter of a pit, and
at least one ridge defined by said pit perimeter gutter, wherein at least one portion of said cover member is engagable with said ridge of said pit perimeter gutter, in abutment engagement relationship therewith.

7. Device for garaging motor vehicles according to claim 5, further comprising, in combination,
at least one beam,
at least one beam-mounted gutter supported by said beam,
at least one stiffening stringer defined by said beam-mounted gutter, and
at least another stiffening stringer defined by said beam-mounted gutter,
wherein at least one portion of said cover member of said device is engagable with said one stiffening stringer of said beam-mounted gutter, and wherein said other stiffening stringer is engagable by a cover member of an adjacent device, in abutment engagement relationship therewith.

8. Device for garaging motor vehicles comprising;
at least one base element;
at least two substantially vertical guides extending upwardly from said base element,
at least one first slider and at least one second slider, each slider being slideably associated with at least one of said guides,
actuation means for simultaneously sliding said first slider and said second sliders along said guides,
at least two vertically spaced-apart platforms rigidly connected to said first slider and said second slider, wherein each of said platforms comprises;
panel means for bearing wheels of motor vehicles, and
gutter means connected to said panel means for conveying liquids away from said motor vehicle wheels supported on said panel means,
whereby to prevent any liquids from dripping onto vehicles accommodated on an underlying platform, and whereby to prevent said panel means from retaining liquids which would remain in contact with said motor vehicle wheels supported on said panel means, wherein each of said platforms further comprises;
at least one bracket connected to said first slider,
at least another bracket connected to said second slider, at least one first profiled element connected to said one bracket, and at least one second profiled element connected to said other bracket, wherein said gutter means comprise at least one gutter formed on said first profiled element and at least one gutter formed on said second profiled element, and wherein said panel means of each of said platforms comprise a plurality of panels, each panel among said plurality of panels being connected to said one profiled element and to said other profiled element.

9. Device for garaging motor vehicles according to claim 8, wherein said at least two substantially vertical guides consist of;

a first fixed guide connected to said at least one base element, and a second fixed guide connected to said at least one base element and being laterally spaced apart from said first fixed guide, said base element extending below said first fixed guide and said second fixed guide, said actuation means comprising at least one hydraulic cylinder and at least another hydraulic cylinder, said one hydraulic cylinder being connected to said base element and to said first slider, said other hydraulic cylinder being connected to said base element and to said second slider, and wherein said gutter means of each of said platforms lies below said panel means for bearing said wheels of motor vehicles.

10. Device for garaging motor vehicles according to claim 8, wherein each panel among said plurality of panels having formed thereon a plurality of U-shaped stiffening ribs.

11. Device for garaging motor vehicles according to claim 8, wherein each panel among said plurality of panels has formed thereon;

a plurality of U-shaped stiffening ribs, and a plurality of grip-ridges, a triangular cross section defined by each of said grip-ridges, and a grip point for said motor vehicle wheel defined by said triangular cross section of each of said grip-ridges.

12. Device for garaging motor vehicles according to claim 8, wherein each panel among said plurality of panels has formed thereon;

a plurality of U-shaped stiffening ribs, and a plurality of grip-ridges, a triangular cross section defined by each of said grip-ridges, a grip point for said motor vehicle wheel defined by said triangular cross section of each of said grip-ridges, at least two ends defined by said grip-ridges, and flat regions defined at said ends of said grip ridges, whereby to permit coupling to contiguous panels.

13. Device for garaging motor vehicles according to claim 12, further comprising at least one crosspiece, said crosspiece underlying said flat regions.

14. Device for garaging motor vehicles according to claim 8 further comprising, in combination, a covering member, said covering member comprising;

a base plate upwardly connected to said first slider and to said second slider and overlying said platforms, an anti-condensation panel resting on said base plate, peripheral profiled element adjacent said base plate, a drip profile covering said peripheral profiled element, bituminous sheaths covering said base plate and said anti-condensation panel, said bituminous sheaths extending upwardly and adhering to said peripheral profiled element, and a pavement surface applied to said bituminous sheaths.

15. Device for garaging motor vehicles according to claim 14, further comprising, in combination;

a pit perimeter gutter, said pit perimeter gutter being installable around the perimeter of a pit, and at least one ridge defined by said pit perimeter gutter, wherein at least one portion of said cover member is engagable with said ridge of said pit perimeter gutter, in abutment engagement relationship therewith.

16. Device for garaging motor vehicles according to claim 14, further comprising, in combination, at least one beam, at least one beam-mounted gutter supported by said beam, at least one stiffening stringer defined by said beam-mounted gutter, and at least another stiffening stringer defined by said beam-mounted gutter, wherein at least one portion of said cover member of said device is engagable with said one stiffening stringer of said beam-mounted gutter, and wherein said other stiffening stringer is engagable by a cover member of an adjacent device, in abutment engagement relationship therewith.

17. Device for garaging motor vehicles comprising;

at least one base element;

at least two substantially vertical guides extending upwardly from said base element, at least one first slider and at least one second slider, each slider being slideably associated with at least one of said guides, actuation means for simultaneously sliding said first slider and said second sliders along said guides, at least two vertically spaced-apart platforms rigidly connected to said first slider and said second slider, wherein each of said platforms comprises;

panel means for bearing wheels of motor vehicles, and gutter means connected to said panel means for conveying liquids away from said motor vehicle wheels supported on said panel means, wherein said at least two substantially vertical guides consist of;

a first fixed guide connected to said at least one base element, and a second fixed guide connected to said at least one base element and being laterally spaced apart from said first fixed guide, said base element extending below said first fixed guide and said second fixed guide, said actuation means comprising at least one hydraulic cylinder and at least another hydraulic cylinder, said one hydraulic cylinder being connected to said base element and to said first slider, said other hydraulic cylinder being connected to said base element and to said second slider, and wherein said gutter means of each of said platforms lies below said panel means for bearing the wheels of motor vehicles, whereby to prevent any liquids from dripping onto vehicles accommodated on an underlying platform, and whereby to prevent said panel means from retaining liquids which would remain in contact with said motor vehicle wheels supported on said panel means, wherein each of said platforms further comprises;

at least one bracket connected to said first slider, at least another bracket connected to said second slider, at least one first profiled element connected to said one bracket, and at least one second profiled element connected to said other bracket, wherein said gutter means comprise at least one gutter formed on said first profiled element and at least one gutter formed on said second profiled element, and wherein said panel means of each of said platforms comprise a plurality of panels, each panel among said plurality of panels being connected to said one profiled element and to said other profiled element.

18. Device for garaging motor vehicles according to claim 17, wherein said panel means of each of said platforms comprise a plurality of panels, and wherein each panel among said plurality of panels has formed thereon:

a plurality of U-shaped stiffening ribs, and a plurality of grip-ridges, a triangular cross section defined by each of said grip-ridges, and a grip point for said motor vehicle wheel defined by said triangular cross section of each of said grip-ridges.

19. Device for garaging motor vehicles according to claim 17, wherein said panel means of each of said platforms comprise a plurality of panels, and wherein each panel among said plurality of panels has formed thereon;

a plurality of U-shaped stiffening ribs, and a plurality of grip-ridges, a triangular cross section defined by each of said grip-ridges, a grip point for said motor vehicle wheel defined by said triangular cross section of each of said grip-ridges, at least two ends defined by said grip-ridges, and flat regions defined at said ends of said grip ridges, whereby to permit coupling to contiguous panels.

20. Device for garaging motor vehicles according to claim 17 further comprising, in combination, a covering member, said covering member comprising;

a base plate upwardly connected to said first slider and to said second slider and overlying said platforms, an anti-condensation panel resting on said base plate, peripheral profiled element adjacent said base plate, a drip profile covering said peripheral profiled element, bituminous sheaths covering said base plate and said anti-condensation panel, said bituminous sheaths extending upwardly and adhering to said peripheral profiled element, and a pavement surface applied to said bituminous sheaths.

21. Device for garaging motor vehicles according to claim 20, further comprising, in combination;

a pit perimeter gutter, said pit perimeter gutter being installable around the perimeter of a pit, and at least one ridge defined by said pit perimeter gutter, wherein at least one portion of said cover member is engagable with said ridge of said pit perimeter gutter, in abutment engagement relationship therewith.

22. Device for garaging motor vehicles according to claim 20, further comprising, in combination, at least one beam, at least one beam-mounted gutter supported by said beam, at least one stiffening stringer defined by said beam-mounted gutter, and at least another stiffening stringer defined by said beam-mounted gutter, wherein at least one portion of said cover member of said device is engagable with said one stiffening stringer of said beam-mounted gutter, and wherein said other stiffening stringer is engagable by a cover member of an adjacent device, in abutment engagement relationship therewith.

* * * * *